US007355122B2

(12) United States Patent
Moore

(10) Patent No.: US 7,355,122 B2
(45) Date of Patent: Apr. 8, 2008

(54) SEALED EURYTOPIC MAKE-BREAK CONNECTOR UTILIZING A CONDUCTIVE ELASTOMER CONTACT

(75) Inventor: Boyd B. Moore, Houston, TX (US)

(73) Assignee: Azura Energy Systems, Inc., Houston, TX (US)

( * ) Notice: Subject to any disclaimer, the term of this patent is extended or adjusted under 35 U.S.C. 154(b) by 0 days.

(21) Appl. No.: 11/395,443

(22) Filed: Mar. 31, 2006

(65) Prior Publication Data

US 2007/0227757 A1 Oct. 4, 2007

(51) Int. Cl.
*H01R 4/00* (2006.01)

(52) U.S. Cl. ..... 174/84 R; 174/92

(58) Field of Classification Search ..... 174/74 R, 174/75 R, 75 F, 77 R, 84 R, 85, 88 R, 93; 439/86, 289, 387, 426, 492
See application file for complete search history.

(56) References Cited

U.S. PATENT DOCUMENTS 3,158,420 A * 11/1964 Olson et al. ..... 439/390
3,478,298 A * 11/1969 Nelson ..... 439/205
3,509,296 A * 4/1970 Lewis et al. ..... 200/46
3,963,133 A * 6/1976 Gilli ..... 414/719
4,740,657 A * 4/1988 Tsukagoshi et al. ..... 174/88 R
4,797,117 A * 1/1989 Ayers ..... 439/200
4,943,243 A * 7/1990 Appleton ..... 439/289
5,120,268 A * 6/1992 Gerrans ..... 439/736
5,409,403 A * 4/1995 Falossi et al. ..... 439/668
5,823,802 A * 10/1998 Bartley ..... 439/86
6,062,872 A * 5/2000 Strange et al. ..... 439/67
6,575,764 B1 * 6/2003 Reipur ..... 439/66
6,790,057 B2 * 9/2004 DelPrete et al. ..... 439/91
6,929,493 B2 * 8/2005 Hall et al. ..... 439/191

* cited by examiner

*Primary Examiner*—William H. Mayo, III
(74) *Attorney, Agent, or Firm*—Gary L. Bush; Andrews Kurth LLP

(57) ABSTRACT

An electrical connection with first and second electrical connectors are adapted to engage each other to form an electrical connection. An electrical wire is connected to each connector. At least one of the connectors has a contact formed of a conductive elastomeric material with conductive particles dispersed in the material, which is shaped to deform when compressed. When the first and second connector elements engage each other contact(s) formed of the elastomeric material will deform to cause electrically conductive particles in the elastomeric material to form an enhanced electrically conductive path through the elastomeric material.

32 Claims, 11 Drawing Sheets

SEALED EURYTOPIC MAKE-BREAK CONNECTOR UTILIZING A CONDUCTIVE ELASTOMER CONTACT

TECHNICAL FIELD

The invention is related to the field of electrical connectors and, more particularly, to eurytropic make-break connectors that can be used underwater and other wet environments, and in a wide variety of other environments.

BACKGROUND OF THE INVENTION

In many applications, particularly for underwater wellheads, there is a need for electrical connections that can be made-up and taken apart in wet conditions. For wellhead connections, these electrical connections typically transmit electrical power from the surface to underwater equipment such as well heads or well control equipment. The connections can also transmit electrical signals from underwater equipment to the surface for processing.

It is an advantage to be able to make-up and take apart these connections underwater without having to bring equipment or components to the surface.

Currently known, wet, make-break connectors typically employ male and female connectors of various types and shapes. One connector relies on the male connector to push out water that might be located in a receptacle that might affect the transmission of electrical current or signals. Another type of known connector fits into a receptacle with a drain opening in it so that water in the receptacle can drain out as the connector is inserted into place. These connectors tend to be expensive and unreliable.

A commonly-used, wet, make-break connector has a plug and a receptacle that is open at two ends, with mating bands of copper extending axially along both parts. When the plug is stabbed into the receptacle, water will be pushed out the other end and the corresponding bands with contact each other to form an electrical connection. This type of connector has been found useful for low voltage and low current applications, but it is not practical for high voltage and high current usage. This type of connector is also difficult to use because it cannot be connected unless the plug is properly oriented or aligned relative to the receptacle in order for the bands on the plug to mate with bands in the receptacle. This type of connector cannot be used between a tubing hanger and an underwater wellhead, which require annular connector elements that do not have to have any specific orientation.

Additionally, in salt water environments exposed conductors cannot be used unless salt deposits on the contacts and adjacent sealing surfaces are cleaned off in order to prevent the connector from shorting to sea water. This requirement is a challenge because it is difficult to design a subsea connection where the contacts and seals are not exposed to salt water.

BRIEF SUMMARY OF THE INVENTION

The invention solves the problems discussed above with a eurytropic make-break electrical connection that has particular applicability underwater and other wet conditions, and in a wide variety of other environments. The term eurytropic refers to the ability of the connection to work effectively in a wide variety of environments. The connection has first and second connectors that are adapted to engage each other to form an electrical connection. At least one of the connectors has a conductor element or contact that is connected to an electrical wire and is formed of a conductive elastomeric material with conductive particles dispersed in the elastomeric material. The conductive elastomeric material is shaped to deform when it engages the other contact and form an electrically conductive path between the connectors.

Either one or both of the contacts can be formed of a conductive elastomeric material. An insulation layer is formed around the conductor elements, with a portion of the elastomeric material being exposed and adapted to engage the conductor on the other connector to form an electrical connection. The exposed portion of the elastomeric material can have a concave exposed end in order to more effectively squeeze water or moisture out from between the contacts.

The contact can be ring-shaped and mounted in a groove formed in a surrounding insulating material. The ring-shaped contact can also have a plurality of alternating conductive and non-conductive regions spaced around the circumference of the ring. Alternatively, the contacts can be cylindrical in shape and have a convex exposed end that is adapted to mate with the other contact.

The connection can be used as an underwater electrical connector for a subsea wellhead or any other type of connector either above or below the water surface where a sealably connected device may be used.

BRIEF DESCRIPTION OF THE DRAWINGS

The invention will be described in greater detail below in conjunction with the appended drawings, in which.

DETAILED DESCRIPTION OF THE INVENTION

Figure 1:
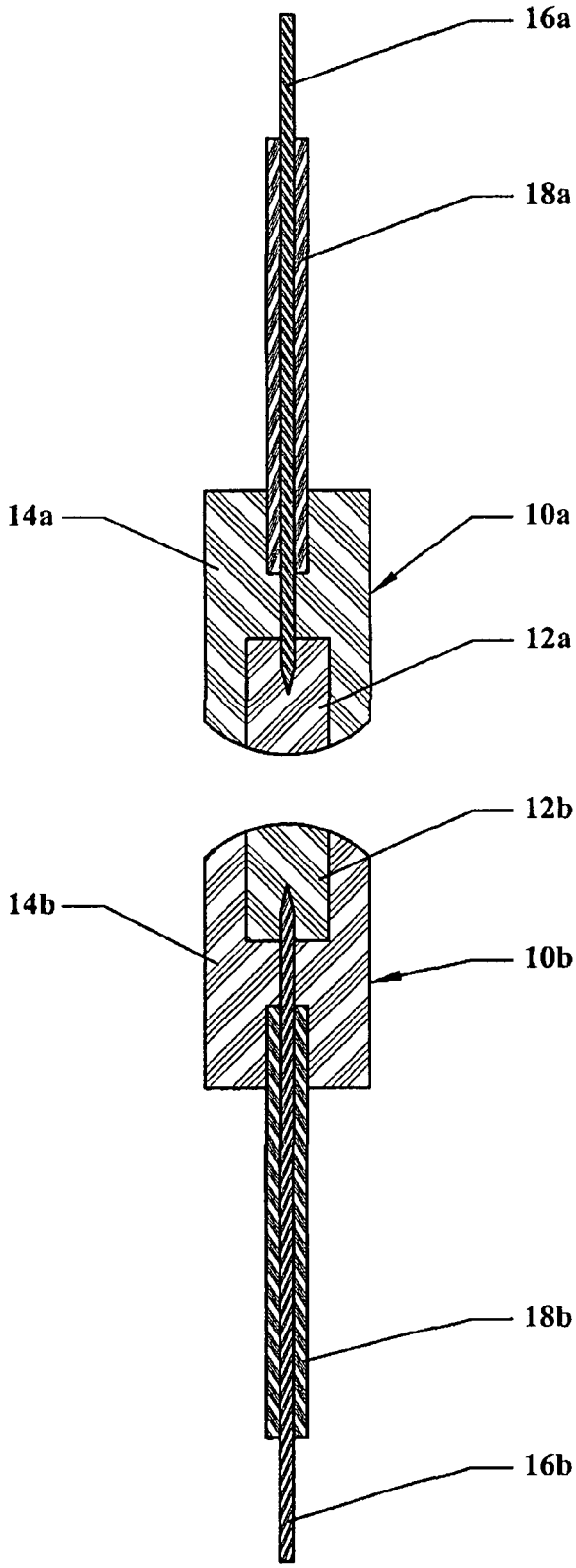
FIG. 1 is a sectional view of an embodiment of the electrical connection of the present invention.

The invention is directed to a eurytropic make-break electrical connection that has advantages for use underwater and in a wide variety of other environments including where the electrical contacts are exposed to wet conditions. Even though the invention is described in conjunction with underwater applications and, in particular, between a tubing hanger and an underwater wellhead, the connection can be used in any application where an electrical connection needs to be made up and taken apart or broken (i.e., a make-break connection).

In underwater applications, for example, conductors for an electrical connection have to be able to provide a dependable electrical connection with each other, which means that all the moisture must be removed from between the contacts and prevented from being trapped in contact with the contacts. A dependable make-break connection that can be used underwater or in other environments, where moisture can be an issue, is formed in accordance with the invention by using one or more conductive elastomeric conductor elements or contacts. One conductive material that can be used for the contacts is a conductive silicone rubber material sold by the Chomerics Division of the Parker Hannifin Corp., Woburn, Mass. This material is formed of a silicone rubber that has clean, high structure, conductive particles such as silver powder dispersed throughout. High structure refers to irregularly-shaped, sharp-cornered particles, which can be contrasted with relatively smooth and round particles that are referred to as having low structure. Particles formed of other types of conductive materials, such as copper or gold, could also be used. When the material is compressed, the particles move into closer contact with each other and form an enhanced electrically-conductive path within the contact material.

An effective underwater, make-break electrical connection can be made by forming one or both of the contacts of such a conductive elastomer material. These contacts are shaped so that when they contact each other, at least one of them is compressed for enhancing the conductivity of the conductive particles inside the contact. When the material is deformed, the conductive particles dispersed throughout the material will move into closer contact with each other and form an enhanced electrically-conductive path in the contact for transmitting electric current from an electric wire in the contact to the other contact. An advantage of using a conductive elastomer as a contact is that neither element in an electrical connection has to be shaped in the form of a receptacle that receives the other one, which eliminates the need to remove moisture from the receptacle. Another advantage of this type of connection is that it does not have any traps or seals that might cause a pressure imbalance when the seal is not made up, so all the exposed parts will have the same relative pressure at all times.

An insulating layer in the form of a protective coating such as silicone grease may be coated on the outer surface of the contact to isolate and prevent oxidation of portions of the conductive particles that are exposed to the atmosphere or water. When one or more of the contacts are compressed sharp edges of the conductive particles penetrate the silicone grease to complete the electrical connection by contacting the other contact.

Figure 2:
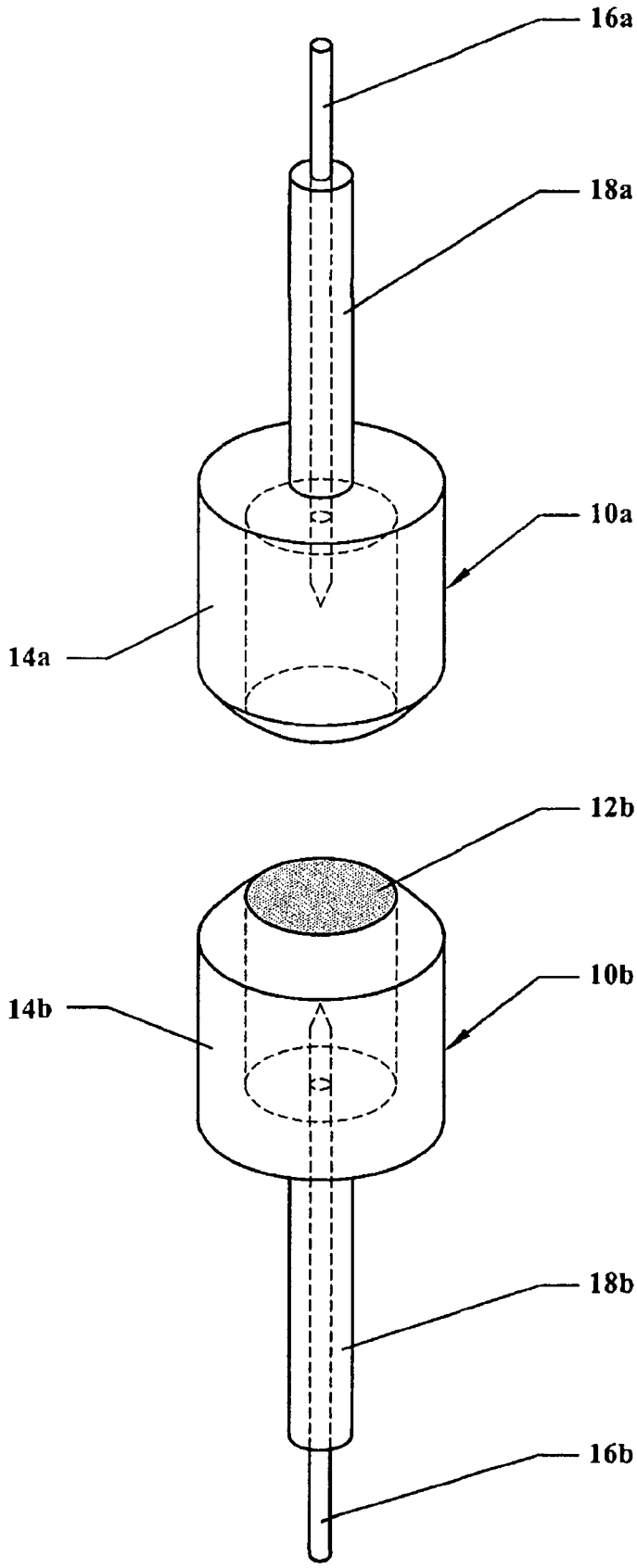
FIG. 2 is a perspective with dotted lines showing internal elements of one embodiment of the connection in FIG. 1, where the connection is cylindrical in shape.
Figure 3:
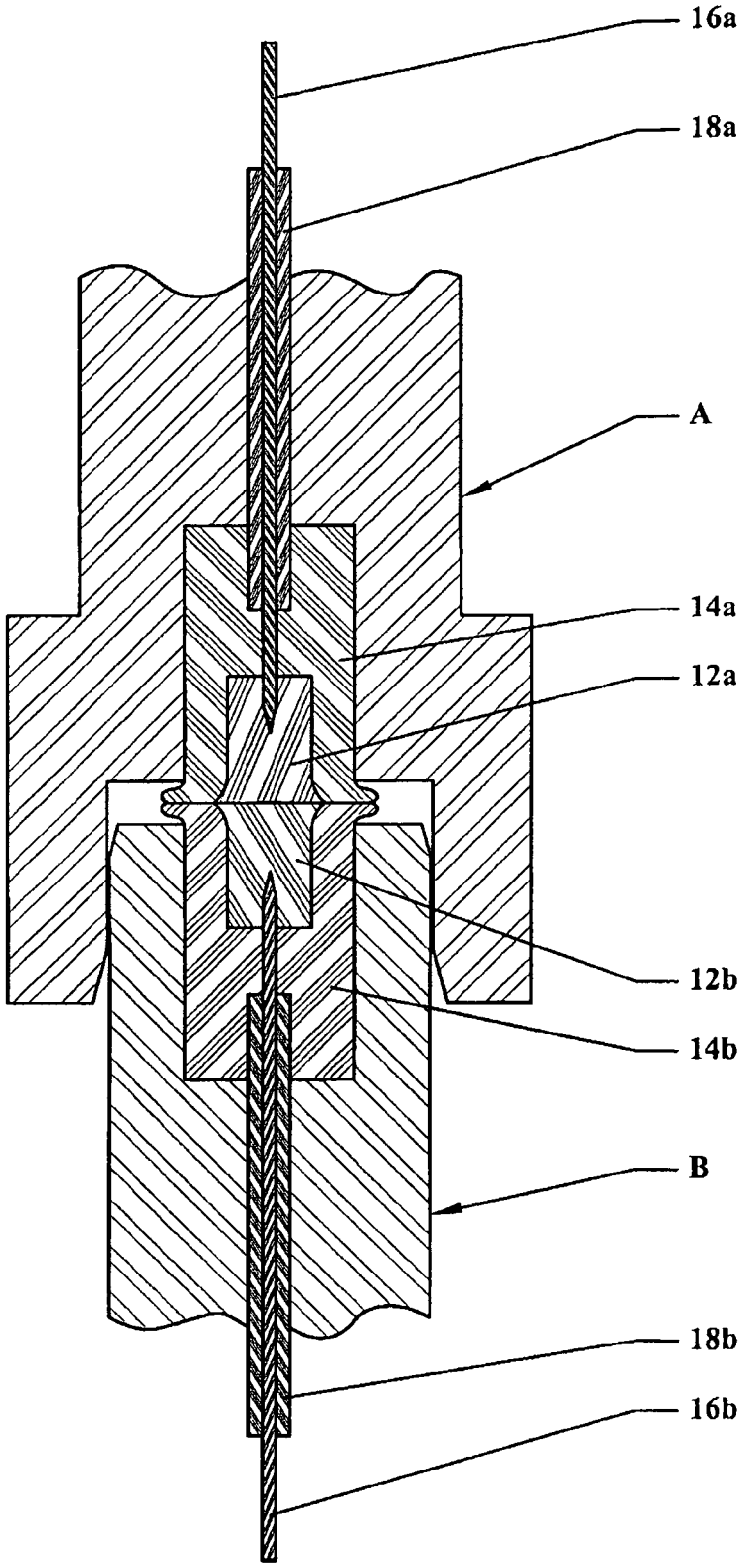
FIG. 3 is a sectional view of the embodiment of the electrical connection in FIG. 1, showing the connector elements being mounted in surrounding structural elements and being connected.

One embodiment of a make-break electrical connection of the invention is shown in FIGS. 1, 2 and 3. The connection includes a pair of cylindrically-shaped connectors 10*a* and 10*b*, which includes conductor elements or contacts 12*a* and 12*b*, formed of a conductive elastomer mounted inside housings 14*a* and 14*b*, that are formed of a suitable insulating material such as neoprene rubber. The exposed portions of the contacts 12*a* and 12*b*, as well as adjacent portions of the housings 14*a* and 14*b* are preferably convex as shown in FIGS. 1-3 so that any moisture between them is squeezed out as they engage each other.

Insulated electrical wires 16*a* and 16*b*, are connected to the connectors 10*a* and 10*b*, respectively, with the insulation 18*a* and 18*b* of the wires being stripped off the wires 16*a* and 16*b* so that they are in electrical contact with the contacts 12*a* and 12*b* as shown. The connectors 10*a* and 10*b* can be molded from appropriate materials as described above to form unitary connector configurations shown in FIGS. 1-3.

The connectors 10*a* and 10*b* can be mounted in structural members such as those identified with reference letters A and B, as shown in FIG. 3. The contact 12*a* can be connected to an insulated electrical wire 16*a* that is connected to a power or signal source (not shown). The other contact 12*b* can be connected to an insulated electrical wire 16*b* that runs to an instrument, tool or other machine (not shown) that needs an electrical signal or power to operate.

FIG. 3 shows how the connection is made up. When the connectors engage each other, the adjacent contacts 12*a* and 12*b*, and housings 14*a* and 14*b* compress and cause any water or moisture between them to squeezed out. By compressing the contacts 12*a* and 12*b*, the conductive particles in the conductive elastomer are compressed into greater contact with each other which, in turn, creates an enhanced conductive path for electrical current through the contacts 12*a* and 12*b*. When the connection is made up as shown in FIG. 3, a moisture-free electrical connection is formed which is insulated from any surrounding structure. By using the conductive elastomeric conductor elements with the sealable arrangement as shown there is no exposure to liquids or a surrounding wet environment with precludes oxidation and corrosion of the electrical conductors.

Figure 11:
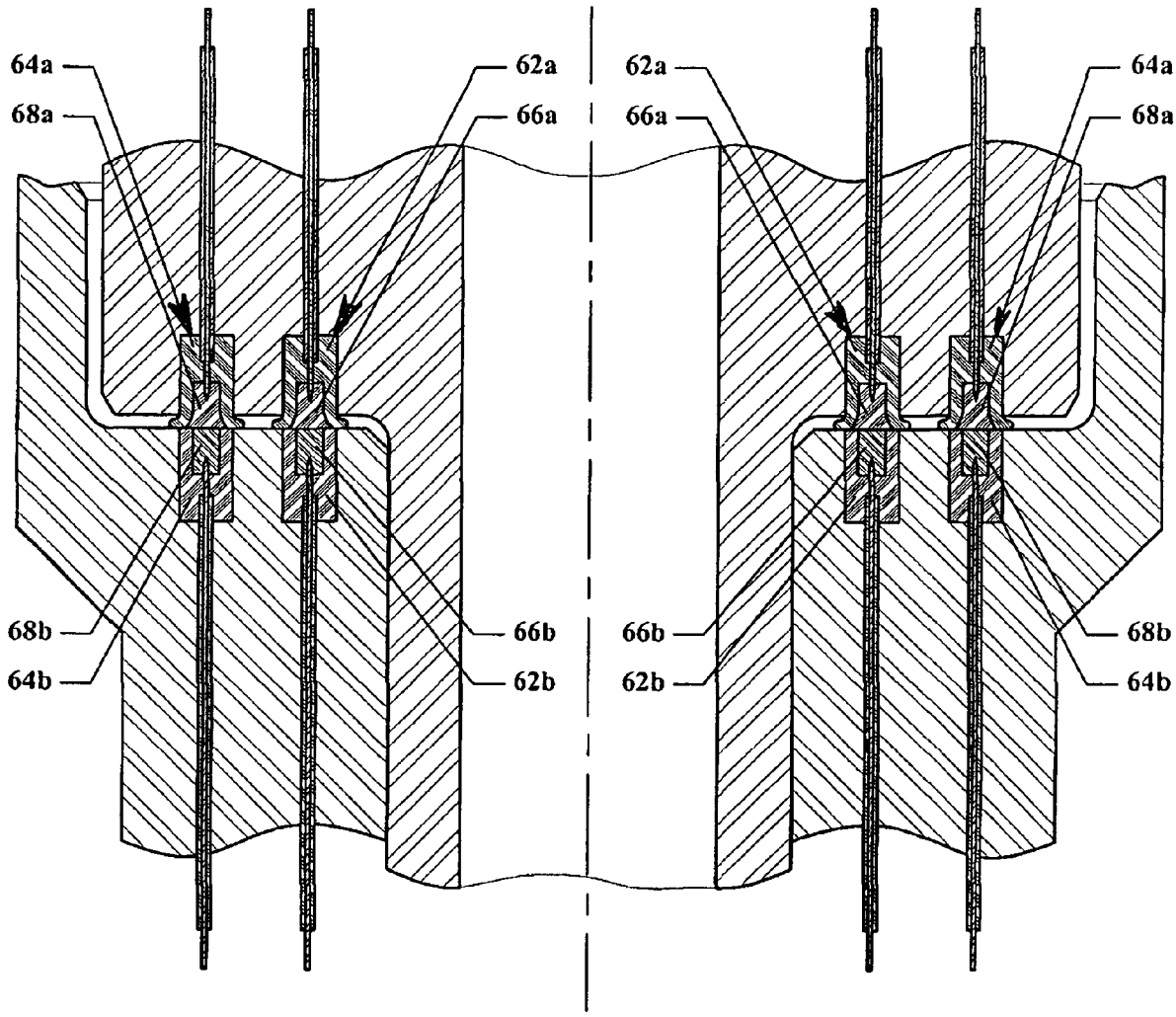
FIG. 11 is an embodiment of a ring-shaped connector invention where one of the connectors has a contact formed of a conductive elastomer and the other contact does not.

An alternative to having both connectors formed with a conductive elastomer contact, is to form only one of the contacts with a conductive elastomer. An example of such a connection is shown in FIG. 11, which is described in greater detail below. Because of the compressibility of the conductive elastomer, an effective water-tight connection can be made with only one of the contacts compressing against an adjacent rigid contact and provide the same benefits.

Figure 4:
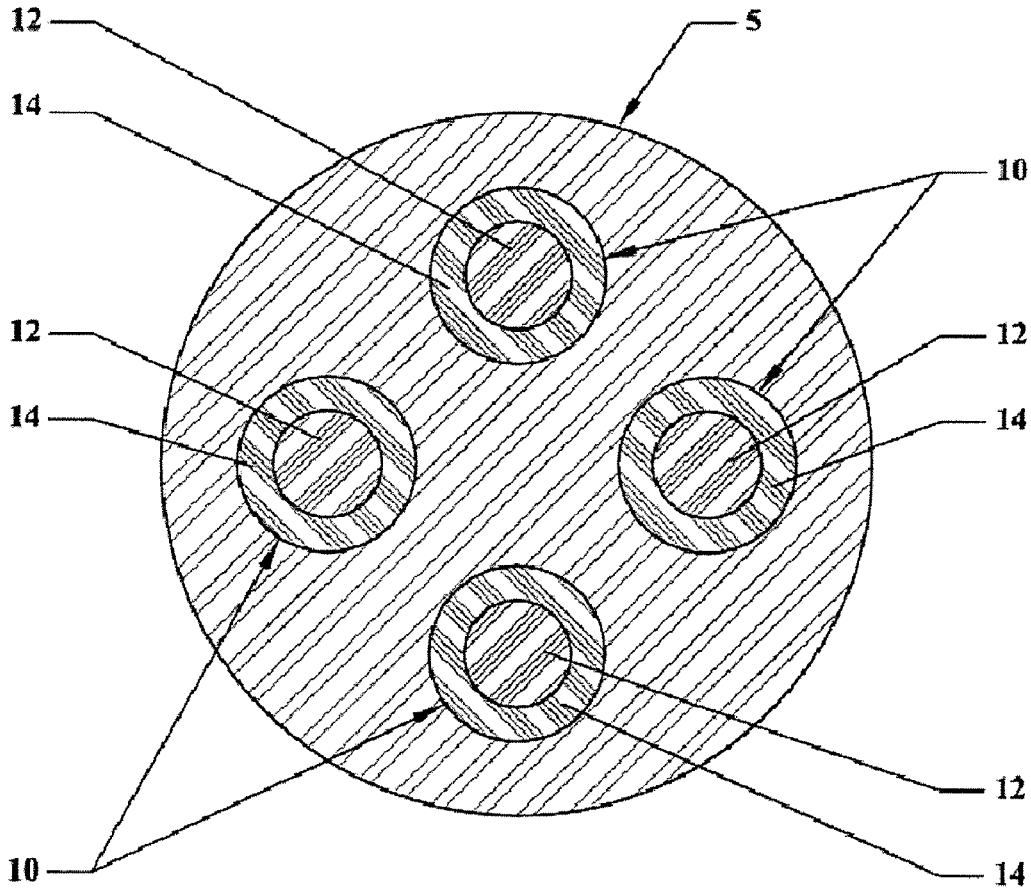
FIG. 4 is a plan view of one arrangement of multiple connectors of the type shown in FIG. 2.
Figure 5:
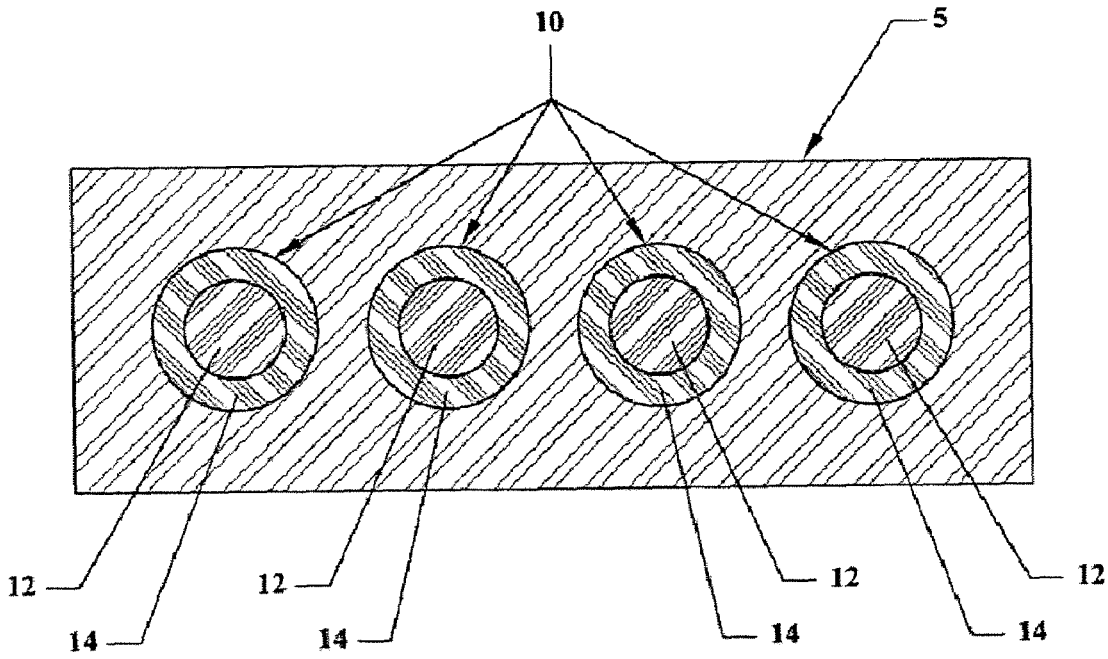
FIG. 5 is a plan view another arrangement of multiple connectors of the type shown in FIG. 2.

The connection can be made up of a single pair of connectors as shown in FIGS. 1-3, or the connection can include multiple connectors 10, as shown in FIGS. 4 and 5, when a number of electrical wires need to be connected. The multiple connectors 10 can be arranged in any number of configurations such as, for example, in a line as shown in FIG. 4 or in a circle as shown in FIG. 5. In FIG. 4, for example, the connectors 10 can include conductor elements 12 molded inside housings 14 that are mounted in a surrounding structure 5. A mating structure (not shown) can be provided with the same configuration so that when the two structures are joined the connections can be completed. Similarly, FIG. 5 illustrates another embodiment where the connectors are arranged linearly in a structure 5. With these types of connections, the connectors have to be aligned when they are joined so the conductor elements on opposite structures 5 can engage each other to provide closed electrical connections.

Figure 6:
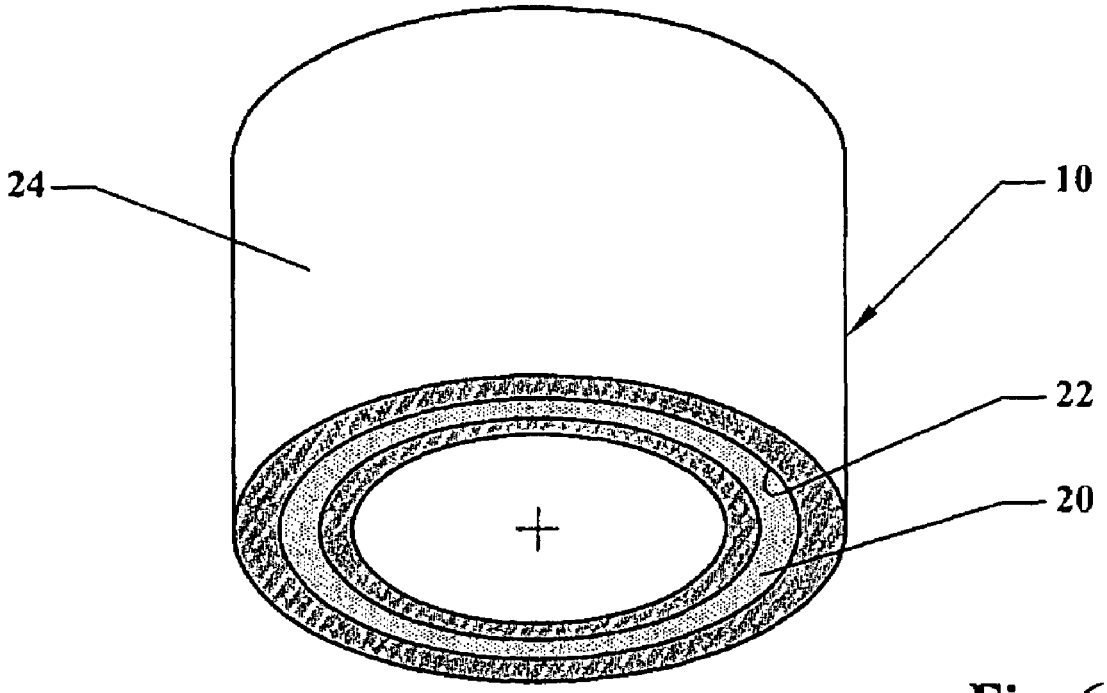
FIG. 6 is a perspective view of another embodiment of the connection where the connectors are ring-shaped.

Alternatively, the connectors 10 can be ring-shaped as shown FIG. 6. In this embodiment, the ring-shaped contact 20 is formed of a conductive elastomer that is positioned in a groove 22 in the insulated housing 24 as shown in FIGS. 6, 9, 10 and 11. This shape is preferable, for example, for connections between tubing hangers and underwater wellheads, shown in FIGS. 8 and 9, as discussed in greater detail below, where the connections must be non-orienting, which means that the connections can be made up without having to radially align contacts on adjacent structures.

Figure 7:
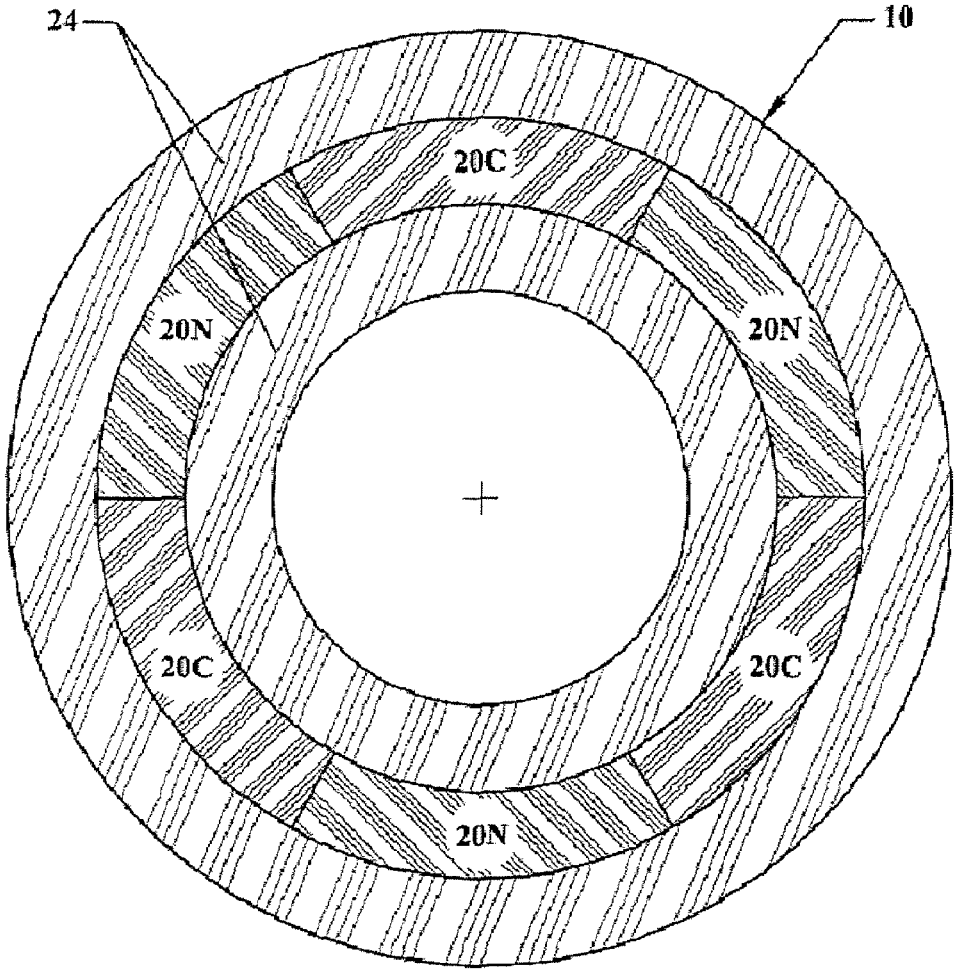
FIG. 7 is a plan view of the embodiment of the connector in FIG. 6 with alternating conducting and non-conducting portions.

The ring-shape contacts 20 can be formed entirely of a conductive elastomer or, alternatively, as shown in FIG. 7, the contact 12 can formed of alternating conductive and non-conductive segments 20C and 20N, respectively. If this contact is used in a radially orienting connection where the contact is aligned to mate with another contact of the same configuration, three conductive paths that are insulated from each other will be provided.

Figure 8:
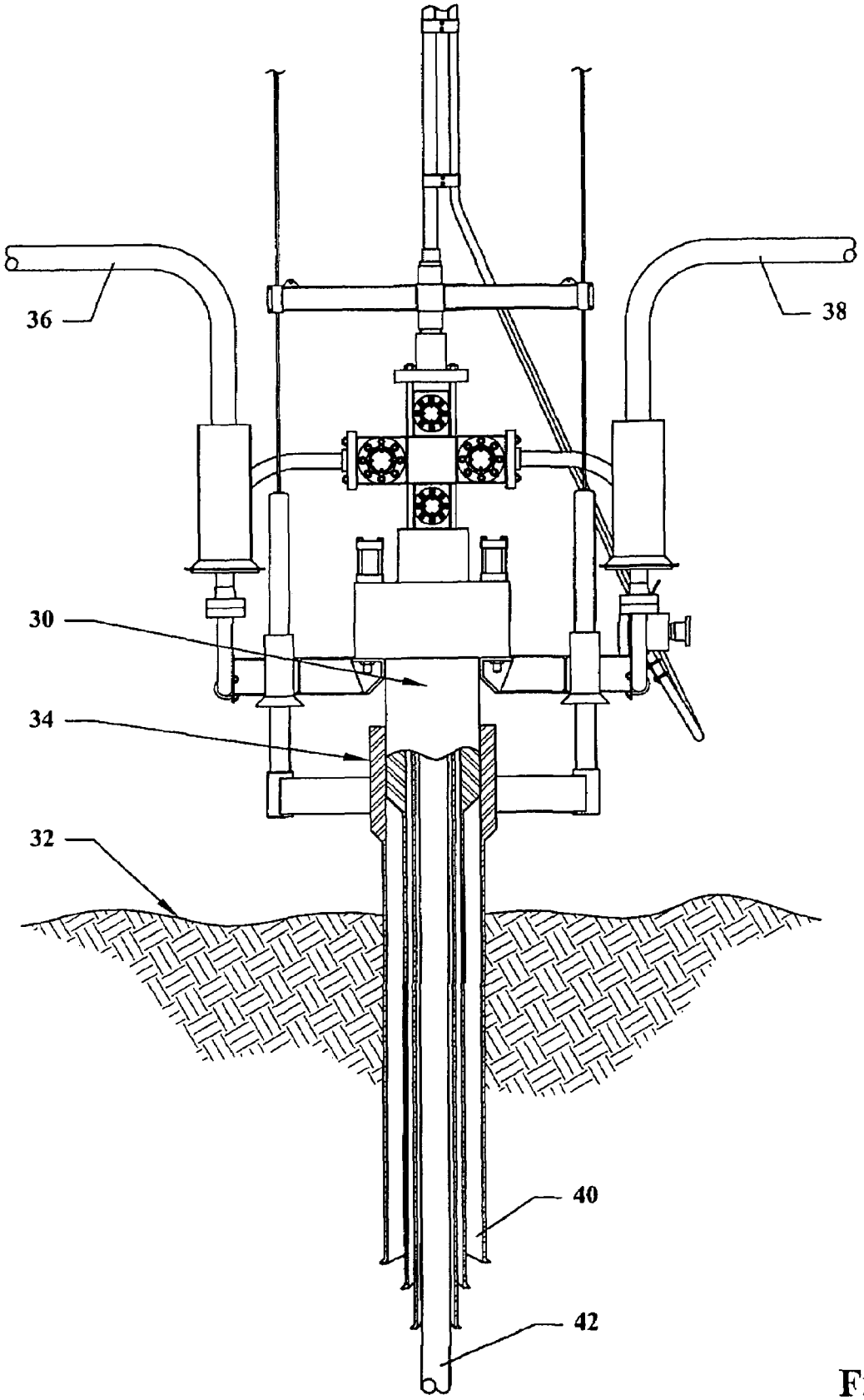
FIG. 8 is an elevational view partially in section of an underwater wellhead in which the connection of the present invention can be used.

The connection of the invention can be used in an underwater wellhead 30 as illustrated in FIG. 8. This type of high pressure wellhead projects above the subsea surface or mudline 32, and includes a conductor housing 34. Flowlines 36 and 38 are connected to the wellhead 30 for transporting produced hydrocarbons to the surface. The wellhead also includes casing and tubing strings 40 and 42, respectively, that are well known.

Figure 9:
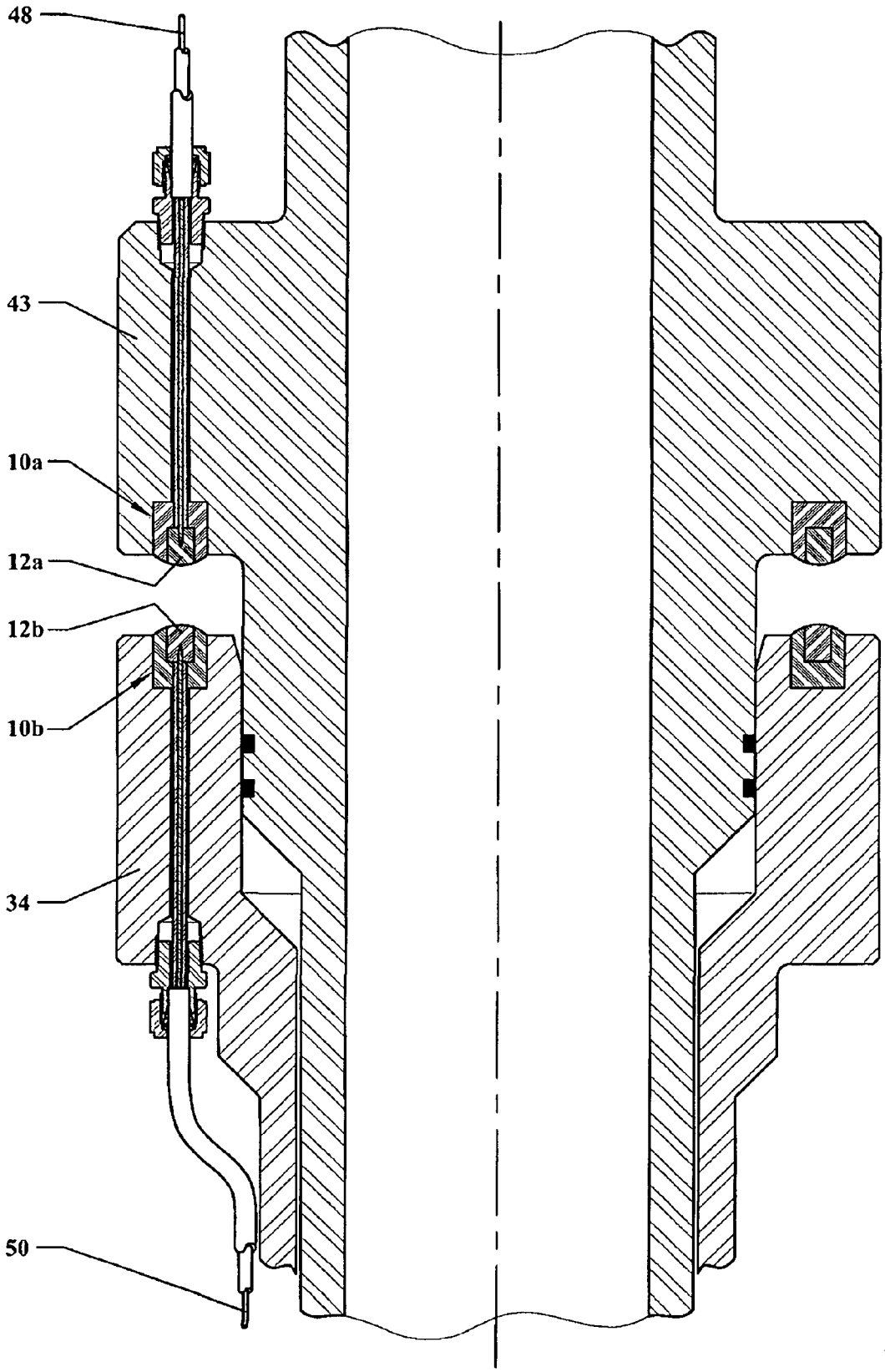
FIG. 9 is a sectional view of a ring-shaped embodiment of the connector of the invention, like the one shown in FIG. 6, in an underwater wellhead.

FIG. 9 shows a typical configuration inside the wellhead 30 where a tubing hanger 43 is designed to engage the conductor housing 34. At least one electrical wire 48 extends through a tubing hanger 43 for supplying power or signals to a downhole tool (not shown). The electrical wire 48 is connected through a make-break connection that is made in accordance with the invention to another electrical wire 50 that extends through the wellhead 10. The connection between the two lines must be able to be made up or broken apart underwater because of the location of the underwater wellhead.

FIG. 9 shows the tubing hanger 43 in a position above the underwater wellhead 30 before the connectors 10*a* and 10*b* engage each other. The connectors 10*a* and 10*b* both have ring-shaped contacts 12*a* and 12*b* as described above. After the tubing hanger 43 is lowered into place in the wellhead 30, the contacts 12*a* and 12*b* engage each other so that the contacts 12*a* and 12*b* will compress and complete an electrical connection between the electrical wires 48 and 50. As the contacts 12*a* and 12*b* compress, any water or other fluid between them will be squeezed out.

The contacts 12*a* and 12*b* for the electrical connection between the tubing hanger 43 and underwater wellhead 30 are preferably ring-shaped as shown in FIG. 6, and exte5*d* around the periphery of the wellhead 30. In this way the connection is non-orienting, which as discussed above means that the contacts 12*a* and 12*b*, do not have to have any particular radial orientation in order to complete the electrical connections between them.

Figure 10:
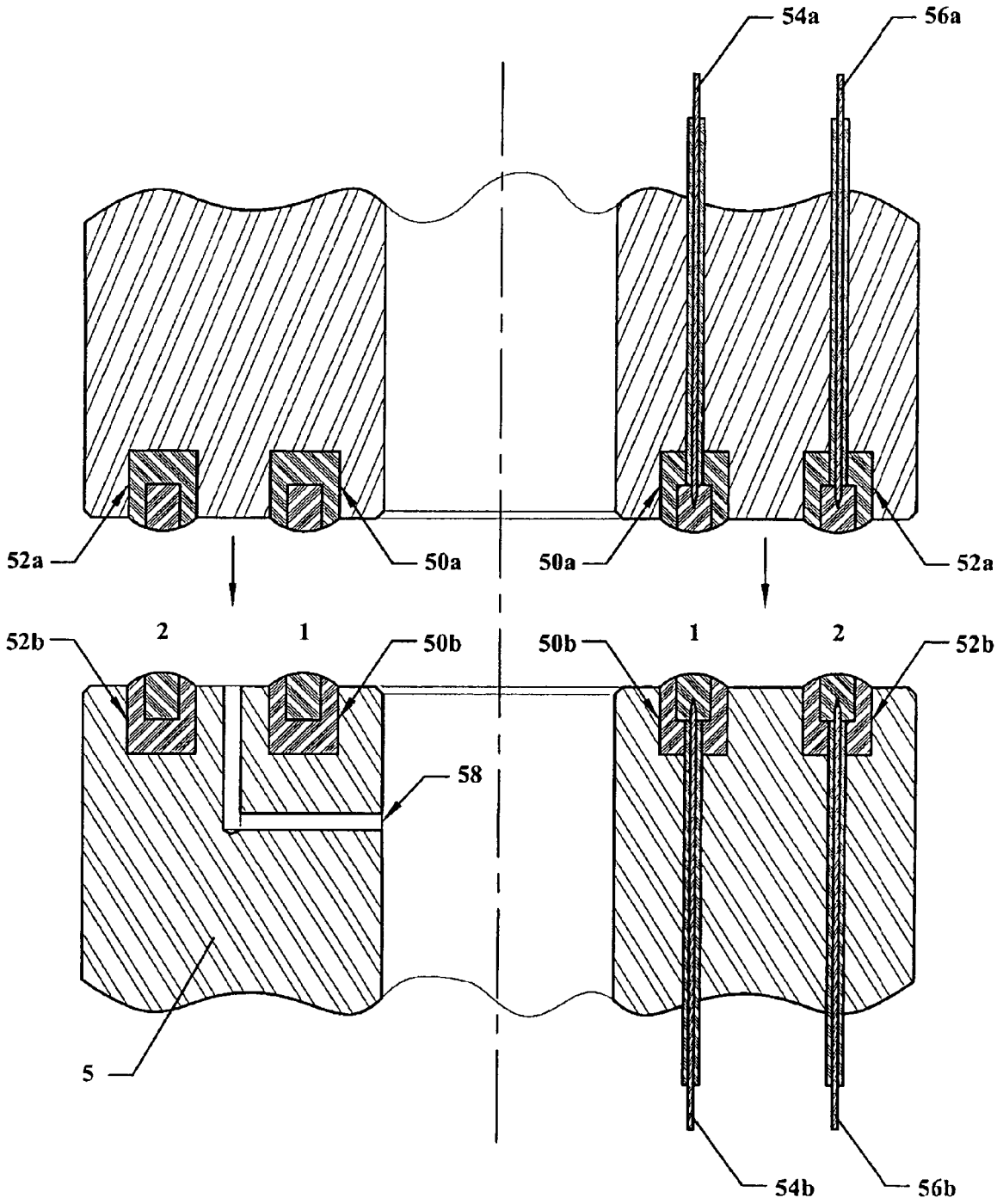
FIG. 10 is a sectional view of another embodiment of the invention where a pair of ring-shaped connectors are used.

As shown in FIG. 10, two pairs of ring-shaped connectors 50*a* and 50*b*, and 52*a* and 52*b*, can be provided in order to provide electrical connections between a two pairs of electrical wires 54*a* and 54*b*, and 56*a* and 56*b*, respectively. When two pairs of ring-shaped connectors are provided as shown in FIG. 10, a conduit 58 should be provided in one of the surrounding structures 5 so that any fluid between the pairs of connectors can escape when the electrical connections are made up.

FIG. 11 shows a made up connection with two pairs of ring-shaped connectors 62*a* and 62*b*, and 64*a* and 64*b*, with the connectors 62*a* and 64*a* including contacts 66*a* and 68*a*, respectively, formed of a conductive elastomer as described above. However, the contacts 66*b* and 68*b* are formed of conventional conductors that are not compressible. As shown in FIG. 11, when the connections are made up the contacts 66*a* and 68*a* are deformed, while the contacts 66*b* and 68*b* are not deformed. The compressibility of only one of the contacts in each set of connectors should provide the connections with sufficient ability to squeeze moisture out from between the connections as the connectors engage each other and come together.

While preferred embodiments of the invention have been described in detail, modifications, and improvements can be made without departing from the spirit of the modifications, variations and improvements are contemplated as being within ended claims.

What is claimed is:

1. An electrical connection, comprising:

a. first and second electrical connectors (10*a*, 10*b*) adapted to engage each other to form an electrical connection;

b. an electrical wire (16*a*, 16*b*) connected to each connector (10*a*, 10*b*);

c. said first and second connectors (10*a*, 10*b*) each comprising a contact (12*a*, 12*b*) formed of a conductive elastomeric material with conductive particles dispersed in the material, said conductive elastomeric material being shaped to deform when compressed;

d. wherein when the first and second connectors (10*a*, 10*b*) engage each other said contacts (12*a*, 12*b*) will deform to cause electrically conductive particles in said elastomeric material to form an enhanced electrically conductive path through the elastomeric material; and e. wherein said deformation of the contacts (12*a*, 12*b*) effectively removes moisture from between the contacts (12*a*, 12*b*).

2. The connection of claim 1, further comprising an insulation layer disposed on an outer surface of the contacts (12*a*, 12*b*).

3. The connection of claim 2, wherein said outer surface of the contacts (12*a*, 12*b*) formed of a conductive elastomeric material is convex.

4. The connection of claim 1, wherein the contact (12*a*, 12*b*) is ring-shaped (20).

5. The connection of claim 4, wherein the contact (12*a*, 12*b*) includes a ring (20) mounted in a groove (22) formed in an insulator element (24).

6. The connection of claim 4, wherein the contact (12*a*, 12*b*) has a plurality of alternating conductive (20C) and non-conductive (20N) regions spaced around the circumference of the ring (20).

7. The connection of claim 1, wherein the contacts (12*a*, 12*b*) are cylindrical in shape.

8. The connection of claim 7, wherein each contact (12*a*, 12*b*) is mounted in a cylinder formed of an insulating material (14*a*, 14*b*) and the contacts (12*a*, 12*b*) have an exposed convex portion that is adapted to mate with each other to form an electrical connection.

9. An underwater electrical connection for a subsea wellhead (30), comprising electrical connectors (10*a*, 10*b*) in accordance with claim 1 mounted on opposed surfaces.

10. An underwater electrical connection comprising, first and second electrical connectors (10*a*, 10*b*) submerged in water and adapted to engage each other; said first and second electrical connectors (10*a*, 10*b*) each having a shape designed to cooperatively remove moisture from between said electrical connectors (10*a*, 10*b*) during engagement;

a first contact (12*a*) of said first electrical connector (10*a*) and a second contact (12*b*) of said second electrical connector (10*b*), said first and second contacts (12*a*, 12*b*) each having an outer surface adapted to engage each other to form a conductive path, said outer surfaces having a shape designed to cooperatively remove moisture from between said contacts (12*a*, 12*b*) during engagement;

a conductive elastomeric material forming at least one of the contacts (12*a*, 12*b*), said conductive elastomeric material having conductive particles dispersed therein and being deformable when compressed such that an enhanced conductive path is formed through the conductive elastomeric material; and an electrical wire (16*a*, 16*b*) connected to each of the first and second electrical connectors (10*a*, 10*b*).

11. The underwater electrical connection of claim 10 wherein, said first and second contacts (12*a*, 12*b*) are both formed of said conductive elastomeric material.

12. The underwater electrical connection of claim 11 wherein, the shape of the outer surfaces of said first and second contacts (12*a*, 12*b*) is convex.

13. The underwater electrical connection of claim 10 wherein, the shape of at least one of the outer surfaces of said first and second contacts (12*a*, 12*b*) formed of said conductive elastomeric material is convex.

14. The underwater electrical connection of claim 10 further comprising, an insulation layer disposed on at least one of said outer surfaces of said first and second contacts (12*a*, 12*b*).

15. The underwater electrical connection of claim 14 wherein, said insulation layer comprises a silicone grease.

16. The underwater electrical connection of claim 10 wherein, the first and second contacts (12*a*, 12*b*) are ring-shaped (20).

17. The underwater electrical connection of claim 16 wherein, at least one of the first and second contacts (12*a*, 12*b*) has a plurality of alternating conductive (20C) and non-conductive (20N) regions spaced around the circumference of the ring (20).

18. The underwater electrical connection of claim 16 wherein, at least one of the first and second contacts (12*a*, 12*b*) formed of a conductive elastomeric material is mounted in a groove (22).

19. The underwater electrical connection of claim 10 wherein, said first and second contacts (12*a*, 12*b*) are cylindrically-shaped.

20. The underwater electrical connection of claim 19 wherein, at least one of said first and second contacts (12*a*, 12*b*) formed of a conductive elastomeric material is mounted within a cylindrical bore formed in an insulating material (14*a*, 14*b*).

21. A method of forming an electrical connection in an underwater location comprising the steps of:

submerging first and second electrical connectors (10*a*, 10*b*) in water with at least one of said first and second electrical connectors (10*a*, 10*b*) having a contact (12*a*, 12*b*) formed of a conductive elastomeric material with conductive particles dispersed in the material, said conductive elastomeric material having a shape to deform when compressed such that an enhanced conductive path is formed through the conductive elastomeric material and moisture is removed from between the contacts (12*a*, 12*b*) of said first and second electrical connectors (10*a*, 10*b*);

arranging said first and second electrical connectors (10*a*, 10*b*) to engage each other to form an electrical connection with an electrical wire (16*a*, 16*b*) connected to each connector (10*a*, 10*b*); and engaging said first and second electrical conductors (10*a*, 10*b*) whereby at least one of the contacts (12*a*, 12*b*) is deformed to remove moisture from between contacting surfaces of said engaging connectors (10*a*, 10*b*) and to form said electrical connection.

22. The method of claim 21 wherein, the first and second electrical connectors (10*a*, 10*b*) both comprise a contact (12*a*, 12*b*) formed of a conductive elastomeric material with conductive particles dispersed in the material.

23. An underwater wellhead (30) comprising:

a tubing hanger (43) having a first electrical wire (48) disposed therein, said first electrical wire (48) connected to a first electrical connector (10*a*);

a conductor housing (34) having a second electrical wire (50) disposed therein, said second electrical wire (50) connected to a second electrical connector (10*b*); said conductor housing (34) arranged and designed to engage with said tubing hanger (43) such that said first and second electrical connectors (10*a*, 10*b*) engage each other;

a first contact (12*a*) of said first electrical connector (10*a*) in electrical contact with said first electrical wire (48) and a second contact (12*b*) of said second electrical connector (10*b*) in electrical contact with said second electrical wire (50), said first and second contacts (12*a*, 12*b*) each having an outer surface adapted to engage each other to form a conductive path, said outer surfaces having a shape designed to cooperatively remove moisture from between said contacts during engagement; and a conductive elastomeric material forming at least one of the contacts (12*a*, 12*b*), said conductive elastomeric material having conductive particles dispersed therein and being deformable when compressed such that an enhanced conductive path is formed through the conductive elastomeric material.

24. The underwater wellhead of claim 23 wherein, said first and second contacts (12*a*, 12*b*) are both formed of said conductive elastomeric material.

25. The underwater wellhead of claim 24 wherein, the shape of the outer surfaces of said first and second contacts (12*a*, 12*b*) is convex.

26. The underwater wellhead of claim 23 wherein, the shape of at least one of the outer surfaces of said first and second contacts (12*a*, 12*b*) formed of said conductive elastomeric material is convex.

27. The underwater wellhead of claim 23 wherein, said first and second electrical connectors (10*a*, 10*b*) each have a shape designed to cooperatively remove moisture from between said first and second electrical connectors (10*a*, 10*b*) during engagement.

28. The underwater wellhead of claim 23 further comprising, an insulation layer disposed on at least one of said outer surfaces of said first and second contacts (12*a*, 12*b*).

29. The underwater wellhead of claim 23 wherein, the first and second contacts (12*a*, 12*b*) are ring-shaped (20).

30. The underwater wellhead of claim 29 wherein, at least one of the first and second contacts (12*a*, 12*b*) has a plurality of alternating conductive (20C) and non-conductive regions (20N) spaced around the circumference of the ring (20).

31. The underwater wellhead of claim 29 wherein, at least one of the first and second contacts (12*a*, 12*b*) formed of a conductive elastomeric material is mounted in a groove (22).

32. The underwater wellhead of claim 23 wherein, said first and second contacts (12*a*, 12*b*) are cylindrically-shaped.

* * * * *